US008342180B2

(12) United States Patent
Martin et al.

(10) Patent No.: US 8,342,180 B2
(45) Date of Patent: Jan. 1, 2013

(54) FILTERING FACE-PIECE RESPIRATOR THAT HAS EXPANDABLE MASK BODY

(75) Inventors: Philip G. Martin, Forest Lake, MN (US); Yonas Gebrewold, Woodbury, MN (US); Daniel J. Stepan, Woodbury, MN (US); Audra A. Wilson, Gateshead (GB); Christopher P. Henderson, High Shincliffe (GB); Thomas G. Skulley, St. Paul, MN (US); Erik J. Johnson, Oakdale, MN (US); Francesco Lovo, Giaveno (IT); Dan Mattano, Turin (IT); Claudio Ponzio, Turin (IT)

(73) Assignee: 3M Innovative Properties Company, St. Paul, MN (US)

( * ) Notice: Subject to any disclaimer, the term of this patent is extended or adjusted under 35 U.S.C. 154(b) by 1176 days.

(21) Appl. No.: 12/190,663

(22) Filed: Aug. 13, 2008

(65) Prior Publication Data

US 2009/0078261 A1 Mar. 26, 2009

Related U.S. Application Data

(60) Provisional application No. 60/974,025, filed on Sep. 20, 2007.

(51) Int. Cl.
*A62B 18/08* (2006.01)

(52) U.S. Cl. ..... 128/206.17; 128/206.12; 128/206.15

(58) Field of Classification Search ..... 128/206.19, 128/205.27, 205.29, 206.12, 206.15–206.17
See application file for complete search history.

(56) References Cited

U.S. PATENT DOCUMENTS

| | | | | |
|---|---|---|---|---|
| 1,502,450 A | | 7/1924 | Wood | |
| 2,382,364 A | | 8/1945 | Yant | |
| RE24,549 E | | 10/1958 | Halliczer | |
| 3,603,315 A | * | 9/1971 | Becker, III | 128/206.19 |
| 3,750,665 A | | 8/1973 | Stranicky | |

(Continued)

FOREIGN PATENT DOCUMENTS

GB 2059782 A 4/1981

(Continued)

OTHER PUBLICATIONS

European Application No. 08797748 Supplementary Search Report dated Jun. 30, 2011.

(Continued)

*Primary Examiner* — Glenn Richman
(74) *Attorney, Agent, or Firm* — Karl G. Hanson

(57) ABSTRACT

A filtering face-piece respirator 10 that includes a mask body 12 and a harness 14. The mask body 12 contains a filtering structure 18 that is retained in position on the mask body 12 by a support structure 16 that includes a longitudinally-movable, centrally-spaced, transversely-extending member 26 that extends from a first side 22 of the structure 16 to a second side 24 without being joined together by any longitudinally-extending members that hinder movement of the transversely extending member 26 in the longitudinal direction. The transversely-extending members converge towards each other at east side 22, 24 of the mask body 12. A filtering face-piece respirator 10 of this construction can allow the mask body 12 to readily accommodate the motion of a person's jaw. Workers who use this filtering face-piece respirator may find it much easier to talk to other persons when working. A single mask size also may be able to properly fit to faces of various sizes.

23 Claims, 7 Drawing Sheets

U.S. PATENT DOCUMENTS

| | | | | | |
|---|---|---|---|---|---|
| 3,757,777 | A | | 9/1973 | Kaufman | |
| D249,072 | S | * | 8/1978 | Revoir | D24/110.1 |
| 4,248,220 | A | * | 2/1981 | White | 128/206.19 |
| D267,985 | S | | 2/1983 | Huber | |
| 4,419,994 | A | * | 12/1983 | Hilton | 128/206.19 |
| 4,454,881 | A | | 6/1984 | Huber et al. | |
| D285,374 | S | | 8/1986 | Huber et al. | |
| 4,630,604 | A | | 12/1986 | Montesi | |
| 4,641,645 | A | | 2/1987 | Tayebi | |
| 4,657,010 | A | | 4/1987 | Wright | |
| 4,688,566 | A | | 8/1987 | Boyce | |
| 4,739,755 | A | | 4/1988 | White et al. | |
| 4,807,619 | A | | 2/1989 | Dyrud et al. | |
| 4,827,924 | A | | 5/1989 | Japuntich | |
| 4,850,347 | A | | 7/1989 | Skov | |
| 4,856,509 | A | * | 8/1989 | Lemelson | 128/206.19 |
| 4,951,664 | A | | 8/1990 | Niemeyer | |
| 5,050,594 | A | | 9/1991 | Babb | |
| 5,094,236 | A | | 3/1992 | Tayebi | |
| D344,608 | S | | 2/1994 | Goryachy et al. | |
| 5,673,690 | A | | 10/1997 | Tayebi et al. | |
| 5,699,791 | A | | 12/1997 | Sukiennik et al. | |
| 6,012,164 | A | | 1/2000 | Deal, III | |
| 6,041,782 | A | | 3/2000 | Angadjivand et al. | |
| 6,148,817 | A | | 11/2000 | Bryant et al. | |
| 6,394,090 | B1 | | 5/2002 | Chen et al. | |
| 6,474,336 | B1 | | 11/2002 | Wolfe | |
| 6,892,730 | B2 | | 5/2005 | Griffiths | |
| 7,086,400 | B2 | | 8/2006 | Shigematsu et al. | |
| 7,121,279 | B2 | | 10/2006 | Dennis | |
| 2003/0205231 | A1 | | 11/2003 | Shigematsu et al. | |
| 2005/0096524 | A1 | * | 5/2005 | Cheng | 600/407 |
| 2005/0211251 | A1 | | 9/2005 | Henderson et al. | |
| 2006/0130841 | A1 | * | 6/2006 | Spence et al. | 128/206.19 |
| 2006/0219246 | A1 | | 10/2006 | Dennis | |

FOREIGN PATENT DOCUMENTS

| | | | |
|---|---|---|---|
| GB | 2176404 | A | 12/1986 |
| GB | 2408213 | A | 5/2005 |
| JP | 2546834 | | 9/1997 |
| JP | 2000-140139 | A | 5/2000 |
| JP | 2000-279537 | A | 10/2000 |
| JP | 2003-093528 | | 4/2003 |
| JP | 2003-320043 | A | 11/2003 |
| JP | 2004-313635 | A | 11/2004 |
| JP | 2005-102818 | A | 4/2005 |
| JP | 3117121 | | 11/2005 |
| JP | 3117120 | | 1/2006 |
| KR | 20-1997-0000011 | | 1/1997 |
| KR | 10-2006-0083536 | | 7/2006 |

OTHER PUBLICATIONS

Moldex 2200 Series N95 Particulate Respirators web page literature [retrieved from the internet on Jul. 19, 2007] http://www.moldex.com/disposableprod/1100n95.htm.

Moldex 2200N Series N95 Particulate Respirators product literature (Sep. 2005).

MD&DI article on Insert Molding by Jim Vance [retrieved from the internet on Feb. 1, 2008] http://www.devicelink.com/grabber.php3?URL=http://www.devicelink.com/mddi/archive/96/04/010.html.

Taber Industries 150-E Instruction Manual.

ASTM Designation D5342-97: Resistance to Bending of Paper and Paperboard (Taber-Type Tester in Basic Configuration).

* cited by examiner

FILTERING FACE-PIECE RESPIRATOR THAT HAS EXPANDABLE MASK BODY

CROSS-REFERENCE TO RELATED APPLICATION

This application claims the benefit of U.S. Provisional Patent Application No. 60/974,025, filed Sep. 20, 2007.

The present invention pertains to a filtering face-piece respirator that has a support structure that includes longitudinally-movable, transversely-extending members. These movable support members enable the respirator mask body to better accommodate jaw movement that occurs when a respirator wearer is talking. The movable support members also allow the mask body to better accommodate a broader range of face sizes and geometries.

BACKGROUND

Respirators are commonly worn over the breathing passages of a person for at least one of two common purposes: (1) to prevent impurities or contaminants from entering the wearer's breathing track; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

Some respirators are categorized as being "filtering face-pieces" because the mask body itself functions as the filtering mechanism. Unlike respirators that use rubber or elastomeric mask bodies in conjunction with attachable filter cartridges (see, e.g., U.S. Patent RE39,493 to Yuschak et al.) or insert-molded filter elements (see, e.g., U.S. Pat. No. 4,790,306 to Braun), filtering face-piece respirators have the filter media comprise much of the whole mask body so that there is no need for installing or replacing a filter cartridge. As such, filtering face-piece respirators are relatively light in weight and easy to use.

Filtering face-piece respirators generally fall into one of two categories, namely, fold-flat respirators and shaped respirators. Fold-flat respirators are stored flat but include seams, pleats, and/or folds that allow the mask to be opened into a cup-shaped configuration for use. Examples of flat-fold filtering face-piece respirators are shown in U.S. Pat. Nos. 6,568,392 and 6,484,722 to Bostock et al. and U.S. Pat. No. 6,394,090 to Chen.

Shaped respirators, in contrast, are more-or-less permanently formed into a desired face-fitting configuration and generally retain that configuration during storage and use. Shaped filtering face-piece respirators regularly include a molded supporting shell structure, generally referred to as a "shaping layer", which is commonly made from thermally bonding fibers or an open-work plastic mesh. The shaping layer is primarily designed to provide support for a filtration layer. Relative to the filtration layer, the shaping layer may reside on an inner portion of the mask (adjacent to the face of the wearer), or it may reside on an outer portion of the mask, or on both inner and outer portions. Examples of patents that disclose shaping layers to support filtration layers include U.S. Pat. No. 4,536,440 to Berg, U.S. Pat. No. 4,807,619 to Dyrud et al., and U.S. Pat. No. 4,850,347 to Skov.

In constructing a mask body for a shaped respirator, the filtration layer is typically juxtaposed against a shaping layer, and the assembled layers are subjected to a molding operation by, placing the assembled layers between heated male and female mold parts (see, for example, U.S. Pat. No. 4,536,440 to Berg) or by passing the layers in superimposed relation through a heating stage and thereafter cold molding the superimposed layers into the shape of a face mask (see U.S. Pat. No. 5,307,796 to Kronzer et al. and U.S. Pat. No. 4,850,347 to Skov).

In known shaped filtering face-piece respirators, the filtration layer—whether assembled into the mask body by either of the above-noted techniques—typically becomes attached to the shaping layer by entanglement of the fibers at the interface between the layers or by binding of the fibers to the shaping layer. Alternatively, the filtration layer may be bonded to the shaping layer shell across its entire inner surface through use of an appropriate adhesive—see U.S. Pat. Nos. 6,923,182 and 6,041,782 to Angadjivand et al. Known filtering face-piece respirators also may be welded at the periphery of the mask body to join the assembled layers together.

SUMMARY OF THE INVENTION

As discussed above, persons skilled in the art of designing filtering face-piece respirators have developed a variety of methods for supporting a filtration layer in a pre-shaped mask body. The mask bodies that have been designed, however, have generally been non-dynamic structures that do not accommodate the motion of the wearer's jaw. Respirator wearers often need to talk to their colleagues when working. The jaw movement that occurs when talking can cause the mask body to shift in location on the wearer's face. When the respirator shifts from its desired position on the wearer's face, opportunities may be created for contaminated air to enter the mask interior unfiltered. In addition, the opening of the jaw tends to pull the mask body downward, causing a clamping action on the nose. The non-dynamic structure of conventional respirators thus may create uncomfortable conditions for the wearer.

The present invention addresses a need for providing a filtering face-piece respirator that can accommodate wearer jaw movement so that the respirator remains suitably and comfortably fitted to the wearer's face during conversation. To this end, the present invention provides a filtering face-piece respirator that comprises: (a) a harness; and (b) a mask body that comprises: (i) a filtering structure that includes a filtration layer; and (ii) a support structure that comprises a plurality of centrally-spaced longitudinally-moveable, transversely-extending members that extend from a first side to a second side and that converge towards each other at each of the first and second sides, wherein there is at least one longitudinally-movable, transversely-extending member that extends from a first side to a second side without being joined together by any longitudinally-extending member(s) that hinders movement of the transversely extending member in the longitudinal dimension.

As indicated above, mask bodies for conventional filtering face-piece respirators have regularly used a support structure that comprised a nonwoven web of thermally bonded fibers or an open-work plastic mesh to support the filtration layer. These conventional support structures were lacking in an ability to dynamically respond to wearer jaw movement. The provision of transversely-extending members that converge at each side in conjunction with at least one longitudinally-movable, transversely extending member allows the support structure to expand longitudinally to better accommodate a person's jaw movement. The ability to accommodate wearer jaw movement in accordance with the present invention can enable the mask body to better remain in its desired position on the wearer's face during use. The expandable nature of the support structure also may allow a single respirator to fit a greater range of face sizes and may alleviate the clamping action on the nose.

GLOSSARY

The terms set forth below will have the meanings as defined:

"bisect(s)" means to divide into two generally equal parts;

"centerline" means a line that bisects the mask vertically when viewed from the front (FIG. 7);

"centrally spaced" means separated from one another along a line or plane that bisects the mask body vertically when viewed from the front;

"comprises (or comprising)" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"contaminants" means particles (including dusts, mists, and fumes) and/or other substances that generally may not be considered to be particles (e.g., organic vapors, et cetera) but which may be suspended in air, including air in an exhale flow stream;

"crosswise dimension" is the dimension that extends laterally across the respirator from side-to-side when the respirator is viewed from the front;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges or inserted-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filtering structure" means a construction that is designed primarily for filtering air;

"first side" means an area of the mask body that is laterally distanced from a plane that bisects the respirator vertically and that would reside in the region of a wearer's cheek and/or jaw when the respirator is being donned;

"harness" means a structure or combination of parts that assists in supporting the mask body on a wearer's face;

"integral" means that the parts in question were made at the same time as a single part and not two separate parts subsequently joined together;

"hinder movement" means impede, restrict, or deprive of movement when exposed to forces that exist under normal use conditions;

"interior gas space" means the space between a mask body and a person's face;

"line of demarcation" means a fold, seam, weld line, bond line, stitch line, hinge line, and/or any combination thereof;

"living hinge" means a mechanism that allows members that extend therefrom to generally pivot thereabout in a rotational-type manner with such ease that damage is not caused to the members or to the hinge joint under normal use;

"longitudinally-movable" and "move longitudinally" means capable of being moved in the longitudinal direction in response to mere finger pressure;

"mask body" means an air-permeable structure that is designed to fit over the nose and mouth of a person and that helps define an interior gas space separated from an exterior gas space;

"member", in relation to the support structure, means an individually and readily identifiable solid part that is sized to contribute significantly to the overall construction and configuration of the support structure;

"perimeter" means the outer edge of the mask body, which outer edge would be disposed generally proximate to a wearer's face when the respirator is being donned by a person;

"pleat" means a portion that is designed to be folded back upon itself;

"pleated" means being folded back upon itself;

"polymeric" and "plastic" each mean a material that mainly includes one or more polymers and may contain other ingredients as well;

"plurality" means two or more;

"respirator" means an air filtration device that is worn by a person to provide the wearer with clean air to breathe;

"second side" means an area of the mask body that is distanced from a plane line that bisects the mask vertically (the second side being opposite the first side) and that would reside in the region of a wearer's cheek and/or jaw when the respirator is being donned;

"support structure" means a construction that is designed to have sufficient structural integrity to retain its desired shape, and to help retain the intended shape of the filtering structure that is supported by it, under normal handling;

"spaced" means physically separated or having measurable distance therebetween;

"transversely extending" means extending generally in the crosswise dimension;

DETAILED DESCRIPTION OF PREFERRED EMBODIMENTS

In practicing the present invention, a filtering face-piece respirator is provided that has the ability to function like an accordion in one or more locations so that the mask body can expand and retract in coordination with the motion of a person's jaw. Workers regularly need to communicate with one another on the job. Conventional filtering face-piece respirators, however, have not used a mask body that enabled significant dynamic movement in coordination with the motion of a wearer's jaw. Accordingly, conventional respirators exhibited an opportunity to shift in location on a wearer's face when the wearer was talking. The nose portion of the respirator also became pulled down against the wearer's nose when the jaw moved in a downward direction. The present invention addresses these drawbacks by providing one or more longitudinally-movable, transversely-extending members that can move apart or move toward another member, as the case may be, when a respirator wearer opens and closes their mouth.

Figure 1:
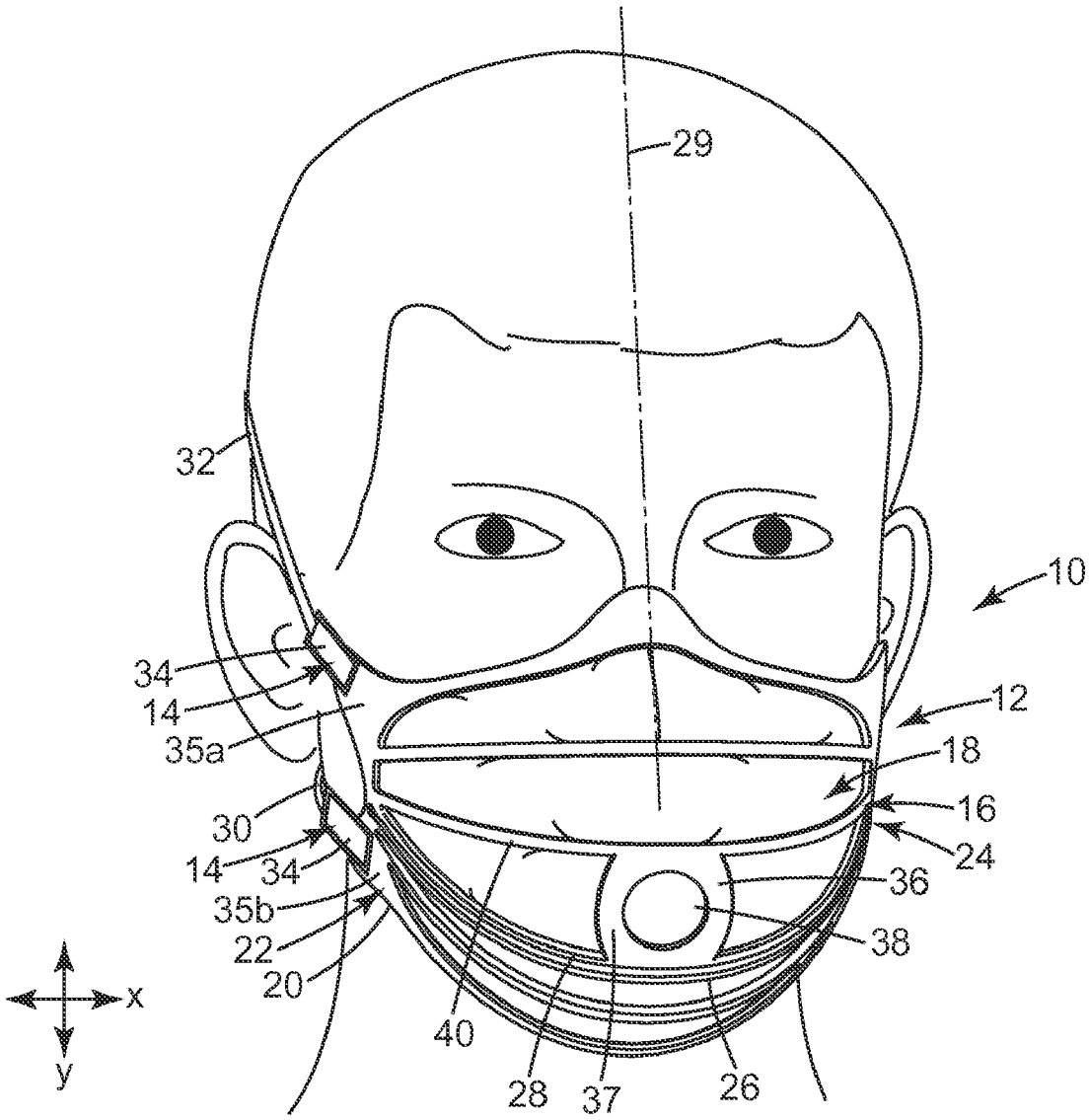
FIG. 1 shows a frontal perspective view of a filtering face-piece respirator 10, in accordance with the present invention, being worn on a person's face.

FIG. 1 shows a respirator 10 that is being worn over the nose and mouth of a person. The respirator 10 includes a mask body 12 and a harness 14. The mask body 12 has a support structure 16 and a filtering structure 18. The support structure 16 includes a perimeter 20, a first side 22, and an opposing second side 24. The perimeter 20 of the support structure 16 may, but not necessarily, contact the wearer's face when the respirator 10 is being donned. The perimeter 20 may comprise a member, or combination of members, that extend 360° continuously about, and adjacent to, the periphery of the mask body 12. The perimeter also can be segmented or discontinuous. Typically, the wearer's face will contact only the inner surface or periphery of the filtering structure 18 (or an inner surface of additional face seal material) so that a comfortable fit is achieved. Thus, the peripheral edge of the filtering structure 18 may extend slightly beyond the perimeter 20 of the support structure 16. The support structure 16 also includes a longitudinally-movable, transversely-extending member 26. This longitudinally-movable, transversely-extending member 26 extends from a first side 22 of the mask body 12 to a second side 24 without being joined together between sides 22 and 24 by any longitudinally-extending member(s) that could hinder movement of the transversely-extending members 26 in a longitudinal direction. That is, there is no structural member that joins member 26 to member 28 so as to restrict member 26 from moving away from member 28 when the wearer expands their jaw or opens their mouth. The longitudinal movement that is beneficially achieved according to the illustrated embodiment is particularly pronounced along the center line 29. Transversely-extending members 26, 28 converge towards each other, moving from centerline 29 to each side 22 or 24 of the support structure 16. When viewing the respirator as projected onto a plane from the front (FIG. 7), the transverse dimension extends across the respirator in the general "x" dimension, and the longitudinal dimension that extends between the bottom and top of the respirator 10 in the general "y" dimension. When viewed through such a planar projection, the transversely-extending member 26 can move towards and away from member 28 in the general "y" direction. In so doing, the member 26 moves towards and away from member 28 a greater distance along the center line 29 than at the first and second sides 22 and 24 where the transversely-extending members merge together. The harness 14 includes first and second straps 30 and 32 that may be adjusted in length by one or more buckles 34. The harness 14 may be secured to the mask body 12 at the first and second sides 22, 24 at harness-securement flange members 35*a*, 35*b*. The buckles 34 may be secured to the mask body 12 at flange members 35*a*, 35*b* by a variety of methods, including stapling, adhesive bonding, welding, and the like. The buckles also may be integrally molded into the support structure 16; see, U.S. Patent Application U.S. Ser. No. 60/974,031, entitled Filtering Face-Piece Respirator Having Integral Harness Buckles filed Sep. 20, 2007. The mask body 12 also includes an optional frame 36 that has an opening 38 located therein. The frame 36 provides a location or foundation for securing an exhalation valve (not shown) to the mask body 12. Although the transversely-extending members 28 and 40 are joined together by longitudinally extending members 37 on the frame 36, the mask body 12 nonetheless may be expanded by relatively free movement between members 26 and 28 and other members that are not so joined relative to one another. Thus, although the invention contemplates having one or more members (2, 3, 4, 5, etc.) that exhibit the capacity to move longitudinally toward or away from each other, not all transversely extending members need to demonstrate such behavior with respect to each adjacent member to accomplish objectives in accordance with the present invention.

Exhalation valves that may be secured to the support structure 16 at frame 36 may have a construction similar to the unidirectional valves described in U.S. Pat. Nos. 7,188,622, 7,028,689, and 7,013,895 to Martin et al.; U.S. Pat. Nos. 7,117,868, 6,854,463, 6,843,248, and 5,325,892 to Japuntich et al.; U.S. Pat. No. 6,883,518 to Mittelstadt et al.; and RE37, 974 to Bowers. The exhalation valve may be secured to the frame 36 by a variety of means, including sonic welds, adhesive bonding, mechanical clamping, and the like. The valve seat may be fashioned to include a cylinder that passes through the opening 38 and that is folded back upon itself in a clamping relationship with the frame 36—see, for example, U.S. Pat. Nos. 7,069,931, 7,007,695, 6,959,709, and 6,604, 524 to Curran et al and EP1,030,721 to Williams et al. A valve cover also can be attached to the valve seat to protect the flap and/or to direct exhaled air downward away from the wearer's eyewear. Examples of valve cover designs are shown in U.S. Patents Des. 347,298 to Japuntich et al. and DES. 347,299 to Bryant et al.

Figure 2A:
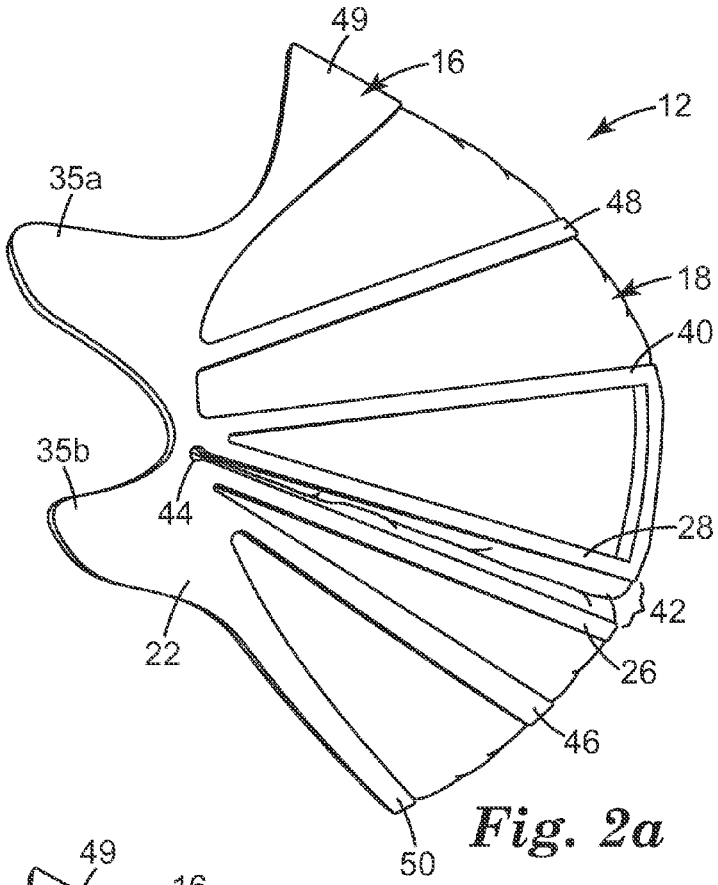
FIG. 2*a* illustrates a side view of a mask body 12, in accordance with the present invention, where the longitudinally-movable, transversely-extending member 26 is located near member 28 in a non-expanded condition.
Figure 2B:
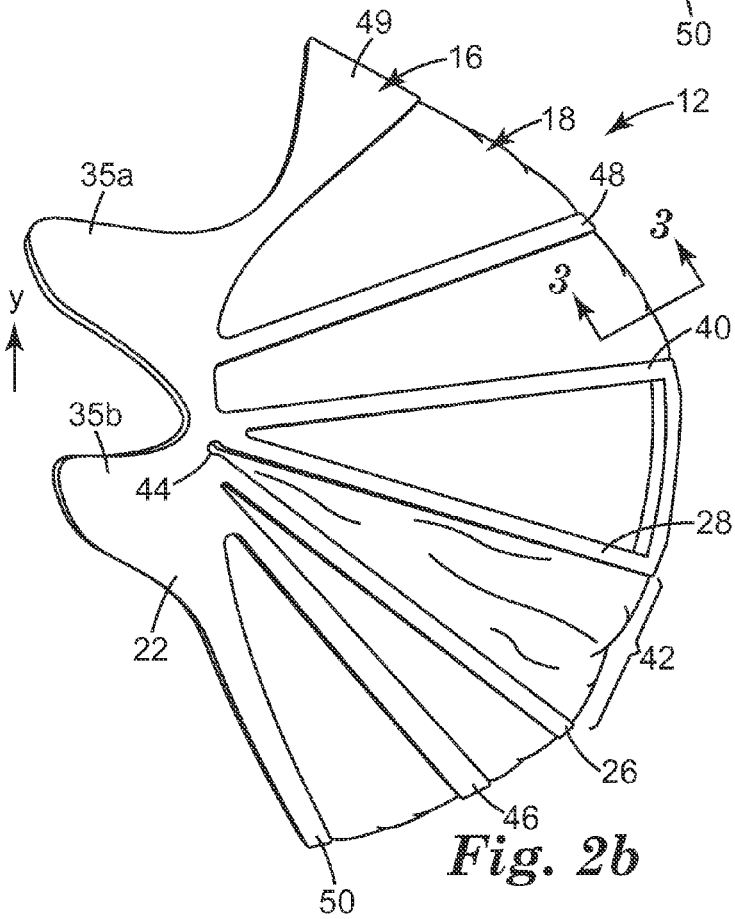
FIG. 2*b* illustrates the mask body 12 where the longitudinally-movable, transversely-extending member 26 is separated from member 28 to place the mask body in an open expanded configuration.

FIG. 2*a* illustrates a side view of the mask body 12 where transversely-extending members 26 and 28 are positioned adjacent to one another such that the filtering structure 18 becomes pleated therebetween in pleatable region 42. The support structure 16 of mask body 12 may further include a living hinge 44 located in the region where movable transversely extending member 26 meets member 28. The living hinge 44 is beneficial in that it allows transversely-extending members 26 and 28 to more easily move towards or away from one another. As shown, the living hinge 44 may have a cul-de-sac shape. The living hinge 44 preferably also is disposed between upper and lower harness attachment flanges 35*a* and 35*b* in the "y" dimension when the mask 12 is oriented in an upright configuration as shown in FIGS. 2*a* and 2*b*. There may be one, two, three, or more living hinges disposed between the point where the harness 14 (FIG. 1) exerts its force on the mask body 12 (in this instance at flanges 35*a* and 35*b*). As shown in FIG. 2*a*, there are other transversely-extending members 46, 48, 49, and 50 that do not have longitudinally-extending members located therebetween away from each side 22 or 24. Thus, while transversely-extending members 46 and 48, for example, may be able to move in a longitudinal dimension to allow the mask body 12 to expand or contract, these members may not be as freely movable as member 26 because the former lacks pleat and a cul-de-sac-shaped living hinge where they come together at the first and second side portions 22 and 24. Therefore, although only one such living hinge 44 is illustrated at each end of the transversely-extending members 26, 28, 46, 48, 49 and 50, the present invention does indeed contemplate using such additional living hinges between additional transversely-extending members. The living hinges may be used where the transversely-extending members meet. There should not, however, be any longitudinally-extending members located between members that are intended to move longitudinally toward or away from one another. As shown, each of the transversely-extending members 26, 28, 40, 46, 48, 49, and 50 converge towards each other in the direction moving away from the centerline 29 (FIGS. 1 and 7) toward each of the sides 22, 24. At each side, the transversely-extending members within the perimeter (i.e. members 26, 28, 40, 46, and 48) may converge towards each other such that all the members are within 35 mm or less from each other when viewed from the side; whereas, the same members may be centrally spaced a total of about 50 to 100 mm at the centerline 29 (FIG. 1).

FIG. 2*b* shows the mask body 12 in a configuration where the pleatable region 42 is expanded. In this configuration, the transversely-extending members 26 and 28 are centrally spaced apart from one another at a near maximum distance. In comparing the mask body configuration of FIG. 2*a* with the configuration of FIG. 2*b*, it is apparent that the mask body 12 of the present invention has the ability to function in an accordion-like manner at pleatable region 42. This ability is particularly beneficial, as indicated above, to accommodate jaw movement of various sized faces. The filtering structure 18 may be attached to the supporting structure 16 of the mask body 12 at one or more, or multiple, contact points. This connection may be made near and along the perimeter 20 of the support structure and/or at various locations where the transversely-extending members 26, 28, 40, 46, 48, 49, and 50 meet the filtering structure 18. The support structure 16 and filtering structure 18 may be secured together by a variety of means including adhesive bonding, welding, over molding and the like. A temporary joining mechanism also could be used, which would allow the support structure 16 to be reused when the filtering structure 18 has met the end of its service life. In such a situation, the wearer could replace the filtering structure 18 and retain the support structure 16 so that only the filtering structure 18 needs to be discarded when the filter has met the end of its service life. One or more of the transversely-extending members preferably has the ability to move longitudinally in response to mere pressure from a person's finger(s). That is, by simply pushing on the transversely-extending member in the longitudinal direction, the transversely-extending member can be readily deflected. The ability of the transversely-extending member to be so easily deflected is further manifested by the Transversely-Extending Member Movement Test (TEMMT) set forth below. Under this test, one or more of the transversely-extending members can move more than 5 mm when subjected to a force of only 0.2N. More preferably, one or more transversely extending members can move at least 10 mm when subjected to a force of only 0.3 under the TEMMT. The longitudinally-movable, transversely-extending members may move a greater distance along the center line 29 (FIGS. 1 and 7) than at the sides 22 and 24 of the mask body. Typically, at least one of the centrally-spaced transversely-extending members can move longitudinally at the center line 29 over a distance of about 5, 10, 15, 20, or even 35 mm without causing significant structural injury to the transversely-extending member when subjected to the Transversely Extending Member Movement Test at a force of only about 0.7 N or less. Typically, the whole mask body may be expanded up to about 20 to 35 mm without causing damage thereto when testing the respirator under the Respirator Expansion Test (RET) set forth below.

The support structure may be made by known techniques such as injection molding. Known plastics such as olefins including, polyethylene, polypropylene, polybutylene, and polymethyl(pentene); plastomers; thermoplastics; thermoplastic elastomers; thermosets, and blends or combinations thereof may be used to make the support structure. Additives such as pigments, UV stabilizers, anti-block agents, nucleating agents, fungicides, and bactericides also may be added to the composition that forms the support structure. The plastic used preferably is able to exhibit resilience, shape memory, and resistance to flexural fatigue so that the supporting structure can be deformed many times (i.e. greater than 100), particularly at any hinge points, and return to its original position. The plastic selected should be able to withstand an indefinite number of deformations so that the support structure exhibits a greater service life than the filter structure. The material selected for the support structure preferably is a plastic that exhibits a Stiffness in Flexure of about 75 to 300 Mega Pascals (MPa), more typically about 100 to 250 MPa, and still typically about 175 to 225 MPa. The Stiffness in Flexure may be determined according to the Stiffness in Flexure Test set forth below. Metal or ceramic material may be used in lieu of plastic to construct the support structure, although a plastic may be preferred for disposal/cost reasons. The support structure is a part or assembly that is not integral to (i.e., made separate from) the filtering structure. The support structure members are sized to be larger than mere fibers or filaments used in the filtering structure. The members may be rectangular, circular, triangular, elliptical, trapezoidal, etc. when viewed in cross-section and may have a cross-sectional area of about 2 to 12 $mm^2$, or more typically about 4 to 8 $mm^2$.

Figure 3:
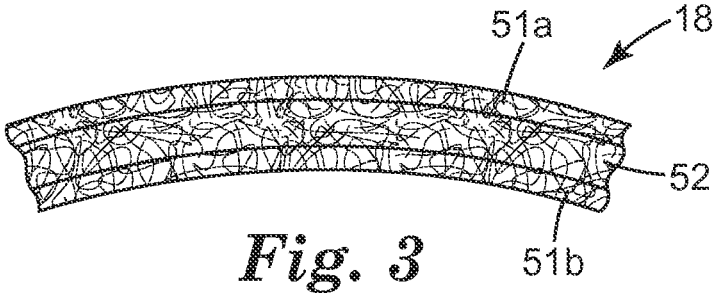
FIG. 3 is a cross-sectional view of the filtering structure 18 taken along lines 3-3 of FIG. 2*b;*

FIG. 3 shows the cross-section of the filtering structure 18. As illustrated, the filtering structure 18 may include one or more cover webs 51*a* and 51*b* and a filtration layer 52. The cover webs 51*a* and 51*b* may be located on opposing sides of the filtration layer 52 to capture any fibers that could come loose therefrom. Typically, the cover webs 51*a* and 51*b* are made from a selection of fibers that provide a comfortable feel, particularly on the side of the filtering structure 18 that makes contact with the wearer's face. The construction of various filter layers and cover webs that may be used in conjunction with the support structure of the present invention are described below in more detail.

Figure 4:
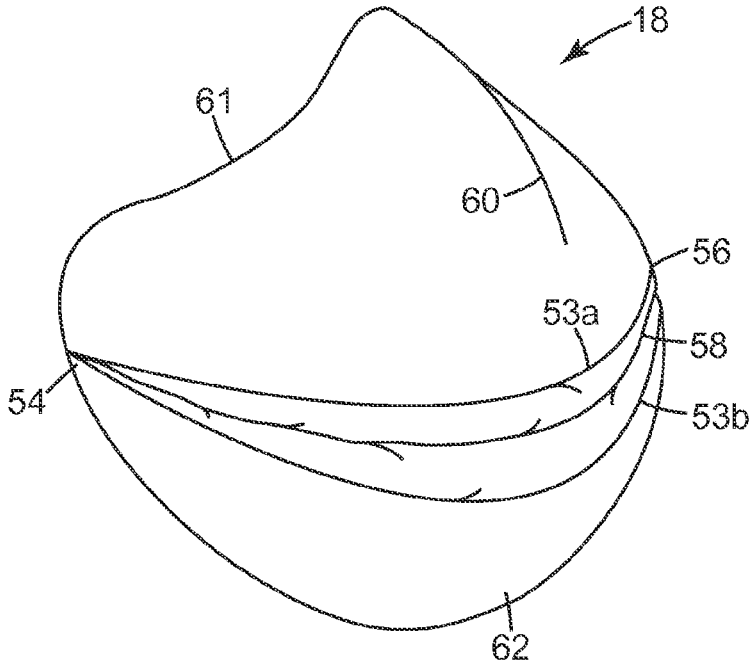
FIG. 4 is a perspective view of the filtering structure 18.

FIG. 4 shows a perspective view of the filtering structure 18, which may include a first and second transversely-extending lines of demarcation 53*a* and 53*b*. These lines of demarcation may be substantially spaced from one another in the central portion of the filtering structure 18 but may converge towards each other, moving laterally in the direction of the sides 54 and 56. The lines of demarcation 53*a*, 53*b* may comprise a fold, weld line, stitch line, bond line, hinge line, or combination thereof. Generally, the first and second lines of demarcation 53*a* and 53*b* correspond to the location of certain transversely-extending members on the support structure. When the first and second lines of demarcation 53*a,* 53*b* define a pleat 58 that may be formed therebetween, the first and second lines of demarcation 53*a,* 53*b* preferably are secured to longitudinally-movable, transversely-extending members 26 and 28 (FIGS. 2*a* and 2*b*), thereby allowing the filtering structure to open and close in an accordion-like manner about the pleat 58 that is located therebetween. The filtering structure 18 also includes a generally vertical line of demarcation 60 that may be provided in the nose region of the filtering structure, extending downwardly and centrally away from the perimeter 61. This vertically-oriented line of demarcation 60 results from the method of making the filtering structure 18. Generally such a line of demarcation 60 is employed to eliminate excess material that would otherwise accumulate in the nose region during the manufacturing process. A similar generally vertical line of demarcation also may be included at the chin portion 62 of the filtering structure 18. Although the filtering structure 18 has been illustrated with only two transversely-extending lines of demarcation 53*a,* 53*b* that would define a single pleat 58, the filtering structure 18 may include two or more of such pleats in the cross-wise dimension. Thus, there can be multiple pleats (3, 4, 5, etc.) where the filtering structure can expand to accommodate a concomitant expansion of the support structure 16 (FIGS. 2*a* and 2*b*). Under such circumstances, the support structure may be provided with multiple living hinges. To improve fit and wearer comfort, an elastomeric face seal can be secured to the perimeter 61 of the filtering structure 18. Such a face seal may extend radially inward to contact the wearer's face when the respirator is being donned. The face seal may be made from a thermoplastic elastomer. Examples of face seals are described in U.S. Pat. No. 6,568,392 to Bostock et al., U.S. Pat. No. 5,617,849 to Springett et al., and U.S. Pat. No. 4,600,002 to Maryyanek et al., and in Canadian Patent 1,296,487 to Yard. Further description of a pleated filtering structure that may be used in conjunction with a movable support structure can be found in U.S. Patent Application Ser. No. 60/974,022, entitled Respirator Having Dynamic Support Structure And Pleated Filtering Structure filed Sep. 20, 2007.

The filtering structure may take on a variety of different shapes and configurations. Preferably the filtering structure is adapted so that it properly fits against or within the support structure. Generally the shape and configuration of the filtering structure corresponds to the general shape of the support structure. The filtering structure may be disposed radially inward from the support structure, it may be disposed radially outward from the support structure, or it may be disposed between various members that comprise the support structure. Although the present filtering structure 18 has been illustrated having multiple layers that include a filtration layer 52 and cover webs 51*a,* 51*b,* the filtering structure simply may comprise a filtration layer or a combination of filtration layers. For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors. Further details regarding filtration layer(s) that may be in the filtering structure are provided below.

Figure 5:
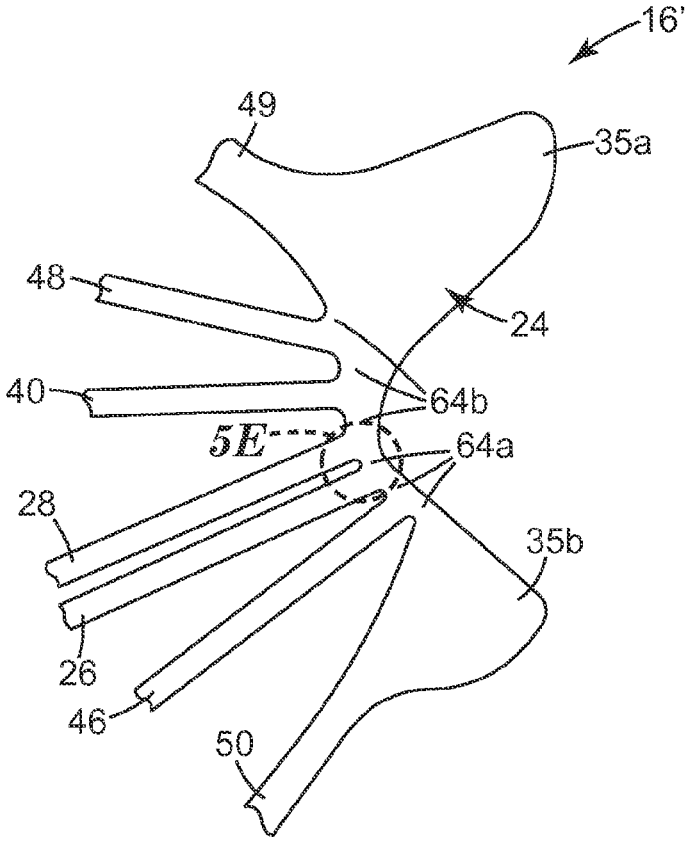
FIG. 5 is a side view of an alternative embodiment of living hinges 64*a,* 64*b* that may be used in a support structure 16' to allow rotational movement of members 26, 28, 40, 46, 48, and 50.

FIG. 5 shows an embodiment of a support structure 16' that has multiple living hinges 64*a* and 64*b*. Living hinges 64*a* have similar constructions and would provide relative ease of rotation about the center point of the hinge. As shown, living hinges 64*a* have minimal width and have the transversely-extending members 26, 28, 46, and 50 spaced not far from one another at the point where they meet each hinge 64*a*. Transversely-extending members 26, 28, 46, and 50 therefore are able to move towards or apart from one another using minimal force. Living hinges that are used in conjunction with the present invention, preferably allow the respirator mask body to exhibit a Maximum Load of less than about 8 Newtons (N), 7 N, and even less than 6 N at a 30% tensile expansion when tested according to the Respirator Expansion Test set forth below. Respirators of the invention also exhibit a Hysteresis of less than 9%, 8%, and even less than 7% when tested under the same test. Living hinges 64*b* as shown, tend to be wider than hinges 64*a* and have greater space in between the transversely-extending members 28, 40, 48, and 49. As such, these hinges—while being able to provide rotational movement of the transversely-extending members—require relatively greater force to enable the transversely-extending members 28, 40, 48, and 49 to move apart from one another. Because the motion from a wearer's jaw generally impacts the lower half of the respirator greater than the upper half, the living hinge(s) preferably are located such that the transversely-extending members are disposed on the lower half of the mask to provide greater ease of movement. The thickness of the transversely-extending members of the support structure may be about 0.25 to 5 mm, more typically about 1 to 3 mm. The thickness of the harness flanges 35*a,* 35*b* typically may be about 2 to 3 mm.

Figure 5E:
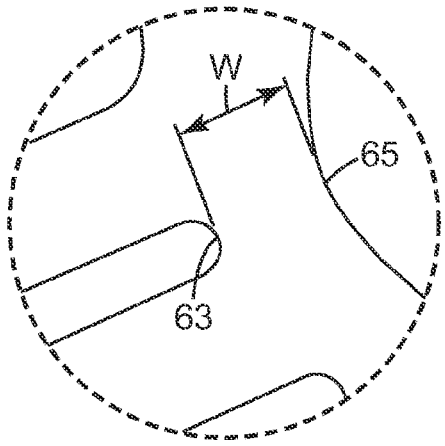
FIG. 5E is an enlarged view of the area within broken-line circle 5E of FIG. 5.

FIG. 5E is an expanded view of the circled area 5E of FIG. 5. As shown in FIG. 5E, the living hinge may be u-shaped and may include an apex 63 and a base 65. The closest distance between the apex 63 and the base 65 is noted as width W. The apex 63 typically is defined by a curvature having a radius that ranges from about 0.1 to 10 mm, more typically about 1 to 4 mm. The width W of the living hinge typically is about 0.3 to 5 mm more typically about 0.5 to 2.5 mm. The living hinge also may be s-shaped or w-shaped or may comprise other shapes as shown in U.S. Patent Application Ser. No. 60/974,017, entitled Filtering Face-Piece Respirator Support Structure That Has Living Hinges, filed Sep. 20, 2007.

Figure 6A:
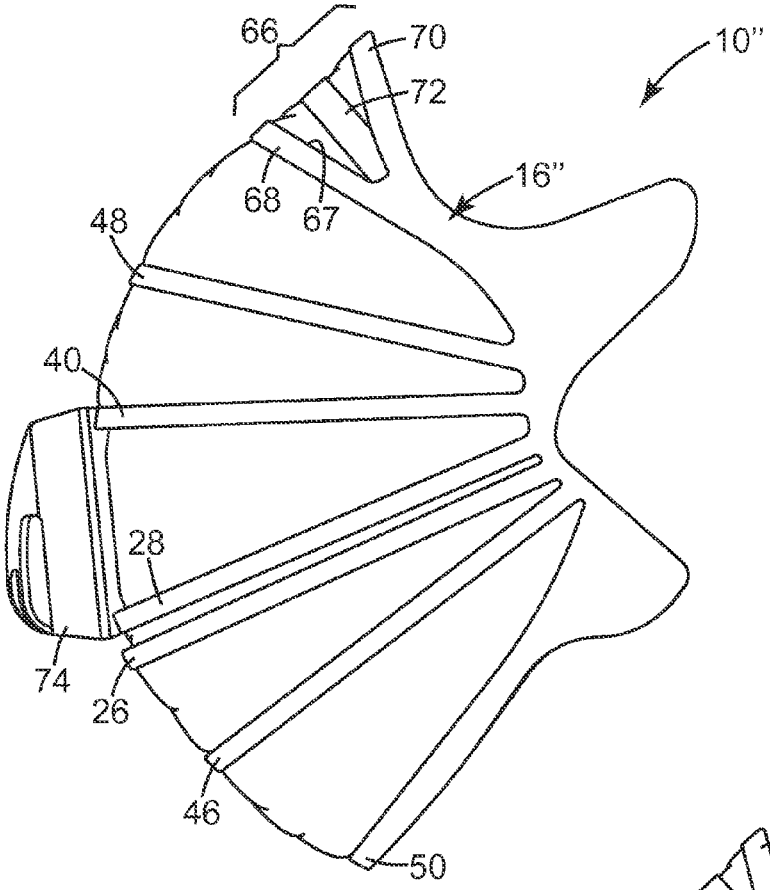
FIGS. 6*a* and 6*b* are side views of a another embodiment of a respirator 10" having a different support structure 16" and including a nose clip 72 and exhalation valve 74.
Figure 6B:
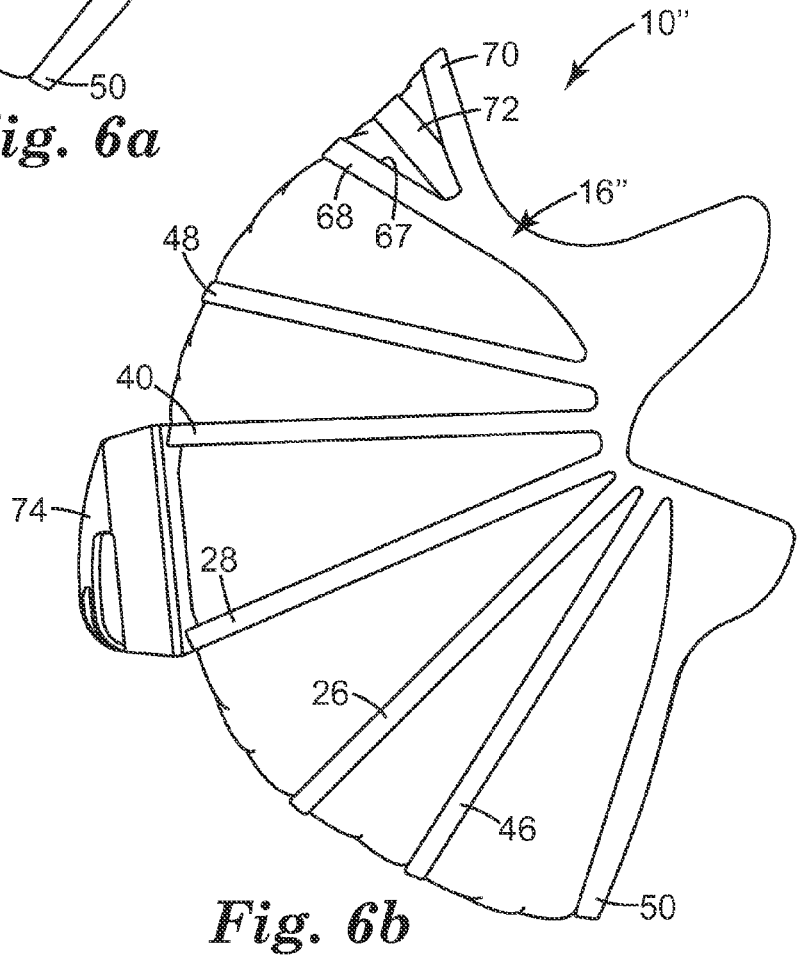

FIGS. 6*a* and 6*b* show another embodiment of a respiratory mask 10". As shown in this embodiment, the nose portion 66 may be provided with a more open configuration to make the mask cooler to wear in that area of the wearer's face. As such, the support structure 16" is not entirely solid in this area but has an opening 67 defined by transversely-extending members 68 and 70. Opening 67 makes nose clip 72 visible to the user and readily accessible for adjustment to allow the mask body 16" to be adapted to the size and shape of the wearer's nose. The nose clip 72 may be made from a malleable strip of metal such as aluminum as described in U.S. Pat. No. 5,558,089 and Des. 412,573 to Castiglione. The nose clip also could take the form of a spring-loaded clip as described in U.S. Patent Publication 2007-0044803A1 to Xue et al. or may be a malleable plastic as described in U.S. Patent Publication 2007-0068529A1 to Kalatoor et al. The embodiment shown in FIGS. 6*a* and 6*b* also illustrates an exhalation valve 74 that is disposed on the mask body between members 28 and 40.

The support structure used in a mask body of the invention also may be constructed using a lesser number of transversely extending members and may exclude the use of a frame (36, FIG. 1) if no exhalation valve is desired. Preferably, there is at least one transversely-extending member that is capable of moving longitudinally relative to another transversely-extending member, including a transversely-extending member that defines the periphery of the support structure. Although the present invention, in its various embodiments, has been illustrated with a support structure that includes multiple transversely-extending members, it may be possible to fashion the mask such that the support structure only includes the peripheral transversely-extending members 49 or 70, and 50. In such an embodiment, it may be desirable to fashion the filtering structure such that it is capable of maintaining its cup-shaped configuration without the need for support from further transversely-extending members. In such an embodiment, the filtering structure may include one or more stiffening layers that allow such a cup-shaped configuration to be maintained. Alternatively, the filtering structure could have one or more horizontal and/or vertical lines of demarcation that contribute to its structural integrity to help maintain the cup-shaped configuration.

The filtering structure that is used in a mask body of the invention can be of a particle capture or gas and vapor type filter. The filtering structure also may be a barrier layer that prevents the transfer of liquid from one side of the filter layer to another to prevent, for instance, liquid aerosols or liquid splashes from penetrating the filter layer. Multiple layers of similar or dissimilar filter media may be used to construct the filtering structure of the invention as the application requires. Filters that may be beneficially employed in a layered mask body of the invention are generally low in pressure drop (for example, less than about 195 to 295 Pascals at a face velocity of 13.8 centimeters per second) to minimize the breathing work of the mask wearer. Filtration layers additionally are flexible and have sufficient shear strength so that they generally retain their structure under expected use conditions. Examples of particle capture filters include one or more webs of fine inorganic fibers (such as fiberglass) or polymeric synthetic fibers. Synthetic fiber webs may include electret charged polymeric microfibers that are produced from processes such as meltblowing. Polyolefin microfibers formed from polypropylene that has been electrically charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures—see U.S. Pat. No. 6,102,039 to Springett et al. and U.S. Pat. No. 3,971,373 to Braun. A sorbent layer can be formed by coating a substrate, such as fibrous or reticulated foam, to form a thin coherent layer. Sorbent materials may include activated carbons that are chemically treated or not, porous alumina-silica catalyst substrates, and alumina particles. An example of a sorptive filtration structure that may be conformed into various configurations is described in U.S. Pat. No. 6,391,429 to Senkus et al.

The filtration layer is typically chosen to achieve a desired filtering effect and, generally, removes a high percentage of particles and/or or other contaminants from the gaseous stream that passes through it. For fibrous filter layers, the fibers selected depend upon the kind of substance to be filtered and, typically, are chosen so that they do not become bonded together during the molding operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other means. Essentially any suitable material that is known (or later developed) for forming a filtering layer may be used for the filtering material. Webs of melt-blown fibers, such as those taught in Wente, Van A., *Superfine Thermoplastic Fibers,* 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles,* Institution Of Mechanical Engineers, London, Proceedings 1B, 1952. Particularly preferred are BMF webs that contain fibers formed from polypropylene, poly(4-methyl-1-pentene), and combinations thereof. Electrically charged fibrillated-film fibers as taught in van Turnhout, U.S. Patent Re. 31,285, also may be suitable, as well as rosin-wool fibrous webs and webs of glass fibers or solution-blown, or electrostatically sprayed fibers, especially in microfilm form. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydro-charging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847B1, 6,397,458B1, and 6,409,806B1 to Jones et al. Typical basis weights for electret BMF filtration layers are about 10 to 100 grams per square meter. When electrically charged according to techniques described in, for example, the '507 patent, and when including fluorine atoms as mentioned in the Jones et al. patents, the basis weight may be about 20 to 40 g/m$^2$ and about 10 to 30 g/m$^2$, respectively.

An inner cover web can be used to provide a smooth surface for contacting the wearer's face, and an outer cover web can be used to entrap loose fibers in the mask body or for aesthetic reasons. The cover web typically does not provide any substantial filtering benefits to the filtering structure, although it can act as a pre-filter when disposed on the exterior (or upstream to) the filtration layer. To obtain a suitable degree of comfort, an inner cover web preferably has a comparatively low basis weight and is formed from comparatively fine fibers. More particularly, the cover web may be fashioned to have a basis weight of about 5 to 50 g/m$^2$ (typically 10 to 30 g/m$^2$), and the fibers are less than 3.5 denier (typically less than 2 denier, and more typically less than 1 denier but greater than 0.1). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web are blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum. Spunbond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 g/m$^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 g/m$^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention preferably have very few fibers protruding from the web surface after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

EXAMPLES

Test Methods

1. Stiffness in Flexure Test (SFT)

The stiffness in flexure of material used to make the support structure was measured according to ASTM D 5342-97 section 12.1 to 12.7. In so doing, six test specimens were cut from a blank film into rectangular pieces that were about 25.4 mm wide by about 70 mm long. The specimens were prepared as described below. Taber V-5 Stiffener tester Model 150-E (from Taber Corporation, 455 Bryant Street, North Tonawanda, N.Y., 14120) was used in 10-100 Taber stiffness unit configurations to measure the test specimens. The Taber Stiffness readings were recorded from the equipment display at the end of the test, and the flexural modulus was calculated using the following equation:

$$\text{Stiffness in Flexure(Pa)} = 7{,}492\frac{\text{Ncm}^4}{\text{M}^2}\left(\frac{\text{Taber Stiffness}}{\text{Width} * \textit{thickness}^3}\right)$$

Taber Stiffness=recorded material resistance to bending measured according to ASTM D5342-97 section 12.1 to 12.7.

Width=width of test film specimen in cm, which was 2.54 cm.

Thickness=average thickness of test specimen in cm measured using standard digital caliper at five equally-spaced locations along the length, of the material.

The stiffness in flexure from the six samples were averaged to get the Stiffness in Flexure of the material.

2. Respirator Expansion Test (RET)

The respirator's Maximum Load at a 30% Tensile Expansion and the Hysteresis were measured under this test. These parameters are indicative of the dynamic performance of the respirator support structure. The Maximum Load at a 30% Tensile Expansion measures the flexibility (or resistance to expansion) of the support structure in the longitudinal dimension under dynamic expansion. Lower Maximum Load values are indicative of greater ease of respirator expansion. The Hysteresis measures the support structure's inability to return to its original shape or condition when the force that causes the change in shape or condition has been removed. Thus, for purposes of the invention, a lower Hysteresis is desired. The Maximum Load at a 30% Tensile Expansional Hysteresis were measured using an Instron, 4302 Universal material testing instrument (from Instron Corporation, 100 Royall Street, Canton, Mass., 02021). During the test, data was collected every 1 second using an Instron Merlin Data acquisition software, also available from the Instron Corporation. The "gauge length" was set in the Instron test equipment such that it was equal to the longitudinal length of the mask body in its relaxed or unstressed condition (D, FIG. 7). For the inventive respirator, the gauge length was set at 114 mm. For a commercially available Moldex 2200 N 95 respirator, the gauge length and was set at 127 mm. A three cycle test for each specimen was set at a 30% expansion at a cross head speed of 254 mm per minute. For each cycle, the data acquisition software generated Maximum Load and Hysteresis data, as well as % Tensile Strain vs. Load.

Figure 7:
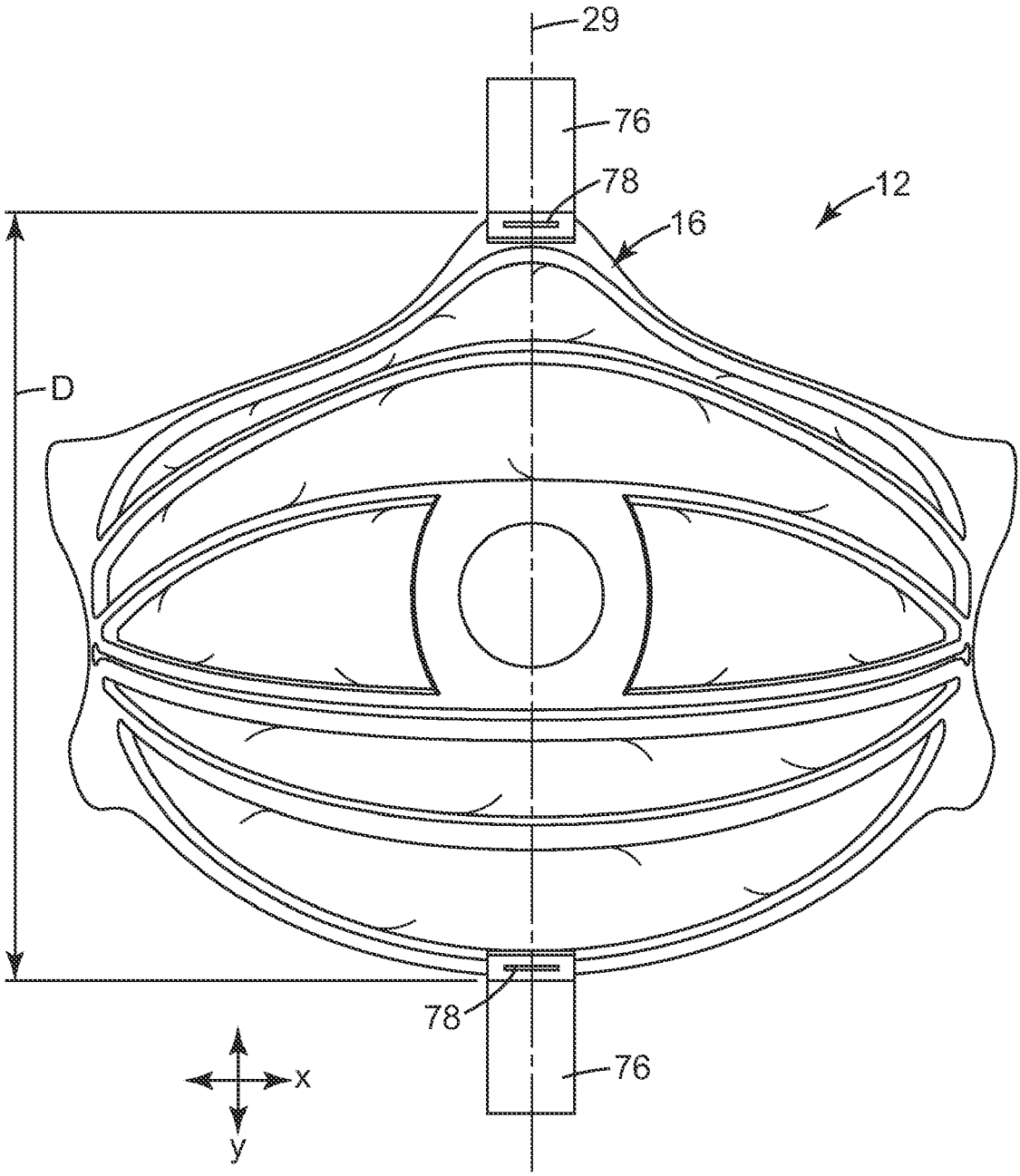
FIG. 7 is a front view of the mask body 12, illustrating a film strip 76 that may be secured to it to assist in expanding the mask body 12 in the longitudinal dimension during testing.

Before testing, a 0.76 mm thick High Density Polyethylene (HDPE) film strip 76 that was 51 mm long and 25.4 mm wide (from Loose Plastic Inc, 3132 West Dale Road, Beaverton, Mich., 48612), was stapled centrally to the top and bottom of the mask body 12 as shown in FIG. 7. The HDPE film 76 was attached to the mask body 12 such that the shape of the respirator was preserved. Two pieces of the HDPE film 76 were attached to the top and bottom of the respirator centrally along bisecting line 29 by placing one piece of the film on the inside and one piece on the outside so that the applied force is more evenly distributed through the mask body 12 (rather than just being applied to the inside or outside). Heavy Duty STANLEY stapler wire 78 (12.7 mm) from Stanley Bostitch, East Greenwich, R.I. 02818 was used to staple the HDPE film 76 to the finished respirators. The tensile expansion was achieved by pulling on the respirator in the "y" direction at tabs 76. To achieve a 30% expansion, the tensile strain was increased from the respirator rest condition at a distance D to a distance of 1.3 D.

3. Transversely-Extending Member Movement Test (TEMMT)

Maximum force required to move the transversely-extending members was measured by imposing tensile strain on the transversally-extending members. The test was done using an Instron 4302 Universal material testing instrument described in the Modulus Test Method above. Gauge length between the two pneumatic grips of Instron test equipment was set at 114 mm. The two transversely-extending members were first set at their relaxed spaced-apart distance, which in this case was 5 mm. The two transversely-extending members were then pulled apart to impose tensile strain thereon. The tensile strain was exerted on the members until they were spaced up to about 3.5 cm beyond the baseline starting point. The distance extended was measured along the center line. The tensile strain was imposed at a cross head speed of 254 mm per minute. The initial rest state 5 mm gap was set as a zero reference point for this test. Each specimen was then tested three times by opening and closing the gap between the two members. Then force versus distance data for each cycle was collected.

Sample Preparation

1. Stiffness in Flexure Test

Test specimens for the Stiffness in Flexure Test were prepared from the same compounded polymer ingredients that were blended together to make the respirator support structure. See Table 2 for the polymeric composition of the support structure. Forty (40) grams of the compound were used to make a circular film that was 114 mm in radius and 0.51 to 0.64 mm thick. The first 40 grams of the compounded material was poured into a twin screw roller blade Type Six BRABENDER mixer (from C.W. Brabender instruments Inc., 50 East Wesley Street, P.O. Box 2127, South Hackensack, N.J., 07606). The mixer was operating at 75 revolutions per minute (RPM) and at a temperature of 185° C. After blending the molten compound for about 10 minutes, the mixture was pressed under 44.5 kilonewtons (KN) of force to make the 0.51 to 0.64 mm thick flat circular film that was 114 mm in diameter. The compression was conducted using a hot platen set at 149° C. The hot platen was a Genesis 30 ton Compression molding press from WABASH Equipments 1569 Morris Street, P.O. Box 298, Wabash, Ind. 46992. Before testing for flexural modulus, the films were cut to the required test specimen sizes of 25.4 mm wide by 70 mm long.

2. Respirator Support Structure Manufacture

Samples of the respirator support structure were made using a standard injection molding process. Single cavity male and female molds, matching the geometry of the frame shown in FIGS. 1-2 were manufactured at a tool manufacturer. At a relaxed state, or while the support structure was still on the mold, the support structure measured 114 mm, top to bottom, and 120 mm from side to side. The measurement was made along a direct line between the highest and lowest points on the perimeter and two living hinge points, respectively while the respirator was in an unstressed state. The targeted thickness of the members that comprised the support structure was 2.5 millimeters. The transversely-extending members were given a trapezoidal cross-section to allow the support structure to be more easily removed from the mold. The cross-sectional area of the transversely-extending members ranged from about 7.5 to 12 $mm^2$.

A 110 Ton Toshiba VIS-6 molding press was used during the injection molding process to make the support structure under the conditions and set points shown in Table 1:

TABLE 1

Respirator Support Structure Injection Molding Conditions

| Process Condition | Set Point | Unit |
|---|---|---|
| Cycle time | 40 | Sec |
| Injection time | 3 | Sec |
| Fill Time | 0.86 | Sec |
| Charge Time | 1-2 | Sec |
| Cooling Time | 12 | Sec |
| Injection Pressure | 276 | MPa |
| Barrel temperature (nozzle, front, center and rear) | 204 | Degree C. |

A compounding of polymers listed in Table 2 below at the specified weight percentages were mixed to obtain the desired physical properties of the support structure.

TABLE 2

Support Structure Composition

| Weight % | Tradename | Material Type | Supplier |
|---|---|---|---|
| 39.72% | Engage 8490 | Polyolefin Elastomer: ethylene-octene copolymer | Dupont Dow Elastomers L.L.C., Bellvue Park Corporate Center, 300 Bellevue Parkway, Wilmington, DE 19809 |
| 39.72% | Hypel PELLD 20 | Linear Low Density Polyethylene | Entec Polymers L.L.C., 2301 Maitland Center Parkway, Suite 240, Maitland, FL 32751 |
| 14.02% | Kraton G1657 | Thermoplastic Elastomer: styrene-ethylene-butylene-styrene block copolymer | Kraton Polymers LLC, 700 Milma, North Tower, 13th Floor, Houston, TX 77002 |
| 0.93% | Atmer 1753 | Erucamide | Unichema North America, 4650 South Racine Avenue, Chicago, IL 60609-3321 |
| 5.61% | Silver Pigment | Pigment | Clariant Masterbatches, 9101 International Parkway, Minneapolis, MN 55428 |
| | UN 5001 Omnicolor Blue Dye* | Pigment | Clariant Masterbatches, 17 Holden Industrial park Holden, MA 01520 |

*Comprised less than 1 wt. % of the total composition.

3. Respirator Filtering Structure Manufacture

Respirator filtering structures were formed from two layers of nonwoven fibrous electret filter material that was 254 mm wide, laminated between one 50 grams per square meter (gsm) outer layer of white nonwoven fibrous spunbond material and one 22 gsm inner layer of white nonwoven fibrous spunbond material having the same width. Both layers of the nonwoven fibrous spunbond materials were made of polypropylene. The electret filter material was the standard filter material that is used in a 3M 8511 N95 respirator. The laminated web blank was cut into the 254 mm long pieces to form a square before being formed into a cup formation that had a three-dimension (3D) pleat extending transversely across the filtering structure.

Figure 8:
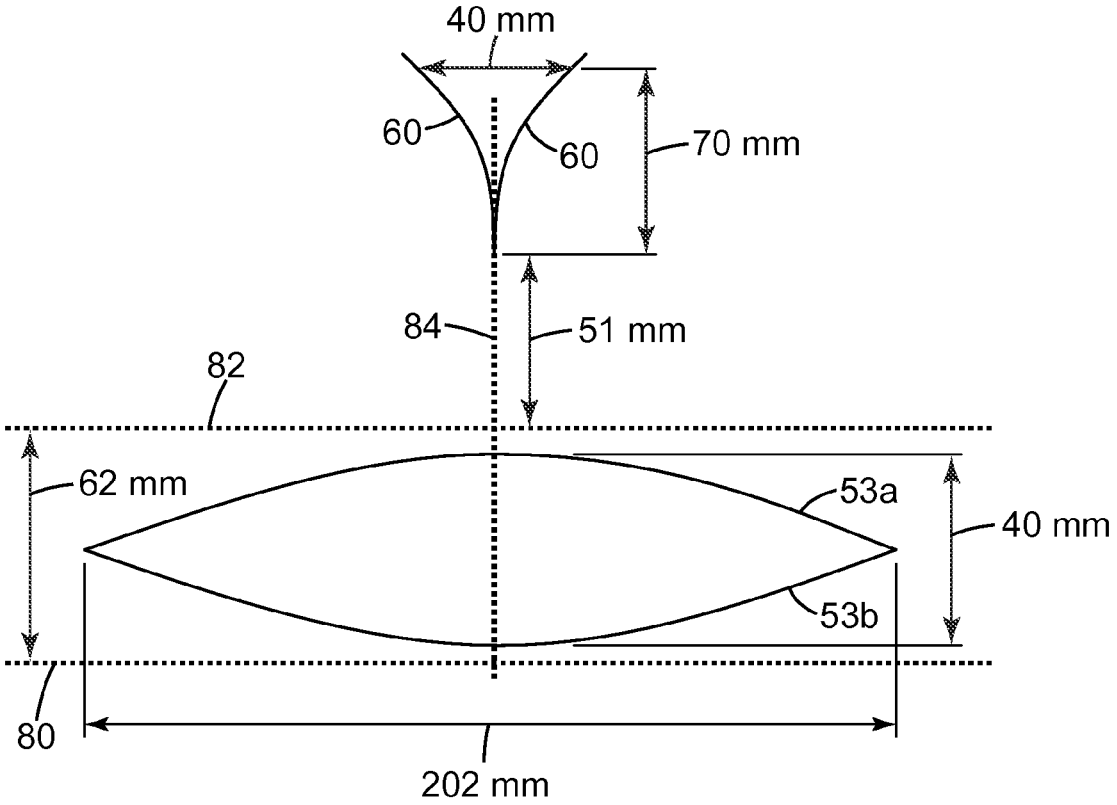
FIG. 8 is a plan view of a blank that is used to form a multi-layered filtering structure 18 (FIG. 4) according to the present invention.

As shown in FIG. 8, where the dotted lines represent fold lines and the solid lines represent weld (or the lines of demarcation 53*a* and 53*b* in FIG. 4), the complex 3D pleat (42, FIGS. 2*a* and 2*b*) was formed by ultrasonically welding two curves 53*a*, 53*b* of same radius of curvature (258.5 mm radius). The distance between the highest points on each curve was 40 mm, and the two ends of the curves met at left and right end points, which were about 202 mm apart. The first curve 53*b* was created by folding the laminated filter media along the first fold line 80 at least 76 mm away from one edge of laminated web. The second curve 53*a* was formed by welding along the secondary curve line by folding the laminated web at a secondary fold line 82, which is located 62 mm from the first fold line 80. Once the two curves that make the 3D pleat are formed, excess material outside of the curve lines was removed. The layered material was then folded along the vertical center line 84 and a line of demarcation 60 (FIG. 4) was welded, starting 51 mm away from the center of the second curve line as shown in FIG. 8. This step removes any excess material and forms a cup that properly fits in the respirator support structure. An ultrasonic welding process was used to make the welds. Branson 2000ae Ultrasonic welding equipment and power supply was used at a peak power mode, 100% amplitude and air pressure of 483 MPa.

4. Other Respirator Components

Face seal: Standard 3M 4000 Series respirator face seal.

Nose clip: Standard 3M 8210 Plus N 95 Respirator nose clip.

Headband: Standard 3M 8210 Plus N 95 Respirator headband material but white in color. The Yellow pigment for 3M 8210 Plus respirator headband was removed.

Buckle: A buckle similar to a back-pack buckle with flexible hinge to allow comfortable adjustment of headband material.

5. Respirator Assembly

The face seal material was cut to pieces that were about 140 mm by 180 mm. A die cut tool was then used to create an oval opening that was 125 mm by 70 mm and was located in the center of the face seal. The face seal with the central cut out opening was attached to respirator filtering structure made as described above. The same equipment that was used to ultrasonically weld the filtering element structure was used to secure the face seal to the filtering structure under similar process conditions. The welding anvil had an oval shape of about 168 mm wide and 114 mm long. After the face seal was joined to the filtering structure, excess material outside of the weld line was removed. The nose clip was adhered to the outside of the assembled filtering structure crosswise over the nose area. Then the pre-assembled filtering element was inserted into the support structure in its desired orientation. The complex 3D pleat was strategically located between transversely extending members 26 and 28 shown in FIGS. 2*a* and 2*b*. A handheld Branson E-150 Ultrasonic welding equipment, at 100% output and 1.0 second weld time, was used to create attachment points between the support structure and the filtering structure at an interval of 20 to 25 mm along each transversely extending member. Four headband buckles were stapled to the harness flanges 35 using 12.7 mm Heavy Duty STANLEY staple wire on both sides of the support structure above and below living hinge 44. A 450 mm long braided headband material was threaded through the buckles to complete the respirator assembly process.

For comparison purposes, five samples of commercially available Moldex 2200 N 95 respirators from Moldex Metric Inc., 10111 W. Jefferson Boulevard, Culver City, Calif. 90232 were also tested according to the Respirator Expansion Test described above. The Moldex 2200 series respirator has a Dura-Mesh™ shell that is designed to resist collapse in heat and humidity. A Moldex face mask that uses an open-work flexible plastic layer as a shell is described in Moldex's U.S. Pat. No. 4,850,347 (Skov).

Test Results

1. Stiffness in Flexure

The compounded ingredients listed in Table 2 were selected to match desired structural and flexibility properties needed for the support structure. The calculated stiffness in flexure for the support structure material is listed in Table 3 below:

TABLE 3

Respirator Support Structure Material Stiffness in Flexure

| Specimen | Thickness (cm) | Taber Stiffness (g · cm) | Stiffness in Flexure (MPa) |
|---|---|---|---|
| 1 | 0.0627 | 14.5 | 173 |
| 2 | 0.0594 | 16.9 | 230 |
| 3 | 0.0561 | 11.9 | 199 |

TABLE 3-continued

Respirator Support Structure Material Stiffness in Flexure

| Specimen | Thickness (cm) | Taber Stiffness (g · cm) | Stiffness in Flexure (MPa) |
|---|---|---|---|
| 4 | 0.0508 | 9.3 | 209 |
| 5 | 0.0546 | 11.3 | 205 |
| 6 | 0.0541 | 10.7 | 196 |
| Average | 0.0563 | 12.4 | 202 |
| Std Deviation | 0.042 | 2.8 | 18.7 |

The data set forth in Table 3 show that the Stiffness in Flexure of the support structure materials is about 200 MPa.

2. Physical Performance of Finished Products

The maximum force required to cause a 30% longitudinal expansion of the mask body and the hysteresis of the support structure were measured on finished respiratory masks using the Respirator Expansion Test described above.

i. Maximum Load For Each Cycle

The Maximum Load required to expand the respirator was measured by recording the maximum force used for each cycle.

TABLE 4

Max Force Data at 30% Longitudinal Expansion

| Product | Example | Max Load First Cycle (N) | Max Load Second Cycle (N) | Max Load Third Cycle (N) |
|---|---|---|---|---|
| Invention prototypes | 1 | 4.4 | 4.3 | 4.3 |
| | 2 | 7.9 | 7.7 | 7.7 |
| | 3 | 6.7 | 6.5 | 6.4 |
| | 4 | 4.7 | 4.5 | 4.5 |
| | 5 | 5.8 | 5.7 | 5.6 |
| Average | | 5.9 | 5.8 | 5.7 |
| Standard Deviation | | 1.5 | 1.4 | 1.4 |
| Moldex 2200 | C1 | 32.8 | 31.3 | 30.5 |
| | C2 | 23.6 | 23.0 | 22.5 |
| | C3 | 25.2 | 23.9 | 23.3 |
| | C4 | 25.4 | 24.4 | 24.0 |
| | C5 | 25.5 | 24.4 | 23.9 |
| Average | | 26.5 | 25.4 | 24.9 |
| Standard Deviation | | 3.6 | 3.4 | 3.2 |

The data shown in Table 4 demonstrate that extraordinarily less force is needed to achieve a 30% tensile expansion of the mask body in the longitudinal dimension when compared to a Moldex 2200 respirator.

ii. Hysteresis after 30% Longitudinal Expansion

TABLE 5

Hysteresis Data

| Product | Example # | Hysteresis First Cycle (%) | Hysteresis Second Cycle (%) | Hysteresis Third Cycle (%) |
|---|---|---|---|---|
| Invention prototypes | 1 | 5.04 | 4.38 | 4.25 |
| | 2 | 8.85 | 7.4 | 7.13 |
| | 3 | 7.66 | 6.45 | 6.18 |
| | 4 | 5.92 | 5.14 | 4.96 |
| | 5 | 7.13 | 5.99 | 5.79 |
| Average | | 6.9 | 5.9 | 5.7 |
| Standard Deviation | | 1.5 | 1.2 | 1.1 |
| Moldex 2200 | C1 | 21.3 | 13.9 | 13.11 |
| | C2 | 16.1 | 11.1 | 10.5 |
| | C3 | 16.6 | 12.6 | 11.9 |

TABLE 5-continued

| Hysteresis Data | | | | |
|---|---|---|---|---|
| Product | Example # | Hysteresis First Cycle (%) | Hysteresis Second Cycle (%) | Hysteresis Third Cycle (%) |
| | C4 | 15.4 | 10.6 | 9.9 |
| | C5 | 18.3 | 13.2 | 12.4 |
| Average | | 17.5 | 12.3 | 11.6 |
| Standard Deviation | | 2.4 | 1.4 | 1.3 |

The data in Table 5 show that the inventive respirators exhibit substantially less Hysteresis when compared to commercially available Moldex 2200 respirators. That is, the respirators that have support structures that include longitudinally-movable, transversely-extending members exhibit substantially less inability to return to their original condition when the longitudinal expansion force has ceased.

iii. Percent Tensile Strain v. Load

Figure 9:
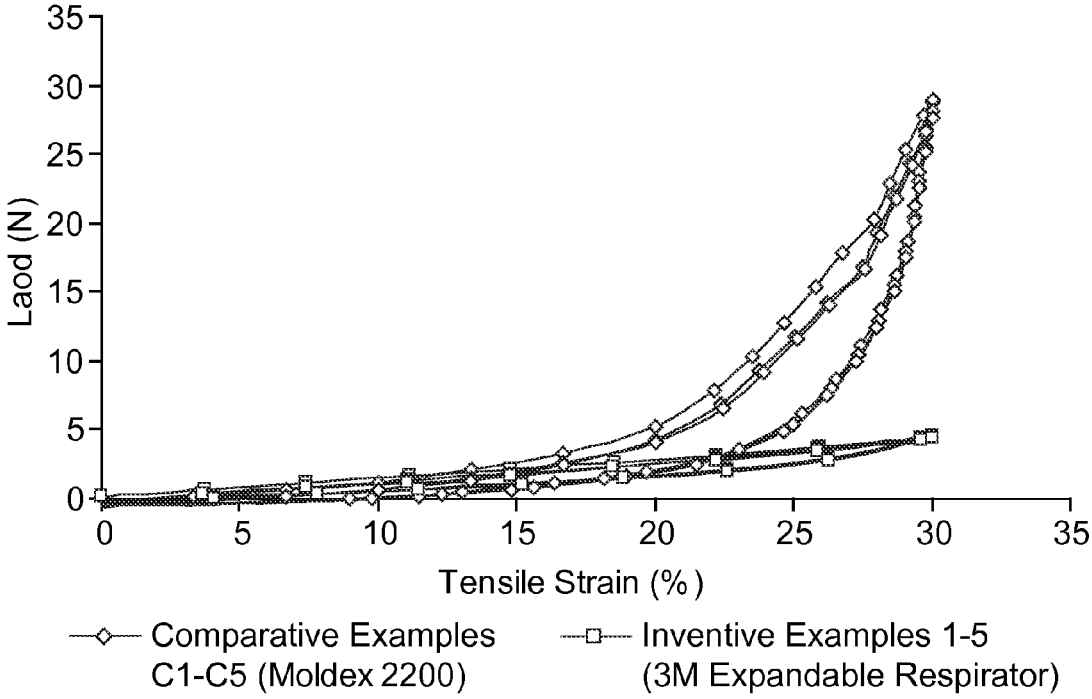
FIG. 9 is a graph that plots Tensile Strain v. Load Curve for filtering face-piece respirators of the present invention and Moldex 2200 filtering face-piece respirators.

The "% Tensile Strain vs. Load" data was plotted on a graph. The plotted data is shown in FIG. 9. As is apparent from the plotted data, the inventive respirator requires substantially less load to strain the respirator 30%.

iv. Transversely-Extending Member Movement Measurements

Five respirator support structures were made as described in sample preparation section above. To eliminate the interference from the rest of the support structure, the 24.5 mm wide and 76 mm long HDPE films described above were attached to the transversely extending members (26 and 28, FIGS. 1, 2*a*, 2*b*) using 12.7 mm Heavy Duty STANLEY stapler wire from Stanley Bostitch.

The force required to longitudinally move the transversely-extending members 26 and 28 of the support structure at the vertical center were measured using test method described above. The forces set forth below in Table 6 represent forces required to extend the transversely-extending members in the longitudinal direction.

TABLE 6

| TEMMT Data | | | |
|---|---|---|---|
| Distance of Longitudinal Extension (mm) From Neutral Rest Position | First Cycle Force (N) | Second Cycle Force (N) | Third Cycle Force(N) |
| 5 | 0.3 | 0.2 | 0.2 |
| 10 | 0.3 | 0.3 | 0.3 |
| 15 | 0.4 | 0.4 | 0.3 |
| 20 | 0.5 | 0.4 | 0.4 |
| 25 | 0.5 | 0.5 | 0.5 |
| 30 | 0.6 | 0.6 | 0.6 |
| 35 | 0.7 | 0.7 | 0.6 |

Figure 10:
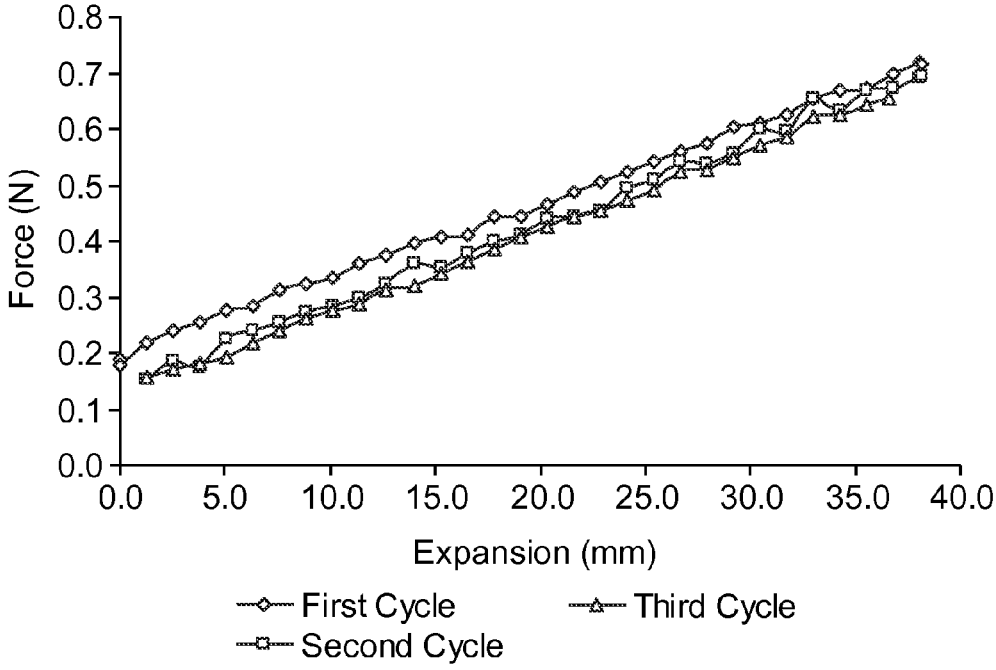
FIG. 10 is a graph that plots the force needed to separate two adjacent transversely-extending members in a respirator of the present invention over a longitudinal distance.

The data set forth in Table 6 show that very little force is needed to separate adjacent transversely-extending members in the longitudinal direction. A graph of this data is set forth in FIG. 10.

This invention may take on various modifications and alterations without departing from its spirit and scope. Accordingly, this invention is not limited to the above-described but is to be controlled by the limitations set forth in the following claims and any equivalents thereof.

This invention also may be suitably practiced in the absence of any element not specifically disclosed herein.

All patents and patent applications cited above, including those in the Background section, are incorporated by reference into this document in total. To the extent that there is a conflict or discrepancy between the disclosure in the incorporated document and the above specification, the above specification will control.

What is claimed is:

1. A filtering face-piece respirator that comprises:

(a) a harness; and (b) a mask body that comprises:

(i) a filtering structure that includes a filtration layer; and (ii) a support structure that comprises a plurality of centrally-spaced longitudinally-moveable, transversely-extending members that extend from a first side to a second side and that converge towards each other at each of the first and second sides, wherein there is at least one longitudinally-movable, transversely-extending member that extends from a first side to a second side without being joined together by any longitudinally-extending member(s) that hinders movement of the transversely extending member in the longitudinal dimension.

2. The filtering face-piece respirator of claim 1, wherein the at least one longitudinally-moveable, transversely-extending member that is not joined together by an longitudinally-extending member that hinders movement in the longitudinal dimension can move longitudinally at the center-line at least 5 mm without causing significant structural injury to the longitudinally-moveable, transversely-extending member.

3. The filtering face-piece respirator of claim 2, wherein the support structure comprises a plurality of longitudinally-moveable, transversely-extending members that can move towards or away from each other longitudinally at the center-line at least 10 mm without causing significant structural injury to either longitudinally-moveable, transversely-extending member.

4. The filtering face-piece respirator of claim 2, wherein the at least one longitudinally-movable, transversely-extending member that is not joined together by an longitudinally-extending member that hinders movement in the longitudinal dimension can move at least 10 mm without causing significant structural injury to the longitudinally-moveable, transversely-extending member.

5. The filtering face-piece respirator of claim 2, wherein the at least one longitudinally-movable, transversely-extending member that is not joined together by an longitudinally-extending member that hinders movement in the longitudinal dimension can move at least 20 mm without causing significant structural injury to the longitudinally-moveable, transversely-extending member.

6. The filtering face-piece respirator of claim 1, wherein the support structure includes a perimeter that comprises one or more members that extend continuously about, and adjacent to, a periphery of the mask body.

7. The filtering face-piece respirator of claim 1, wherein the perimeter comprises first and second transversely-extending members that are each capable of longitudinal movement at the centerline of the mask body over a distance of at least 10 millimeters without causing damage thereto.

8. The filtering face-piece respirator of claim 1, wherein the support structure includes first and second flange members on each of the first and second sides of the support structure.

9. The filtering face-piece respirator of claim 8, wherein the harness is secured to the first and second flange members on each side of the mask body.

10. The filtering face-piece respirator of claim 9, wherein the at least one longitudinally-movable, transversely-extending member is disposed, at least in part, between locations where the harness is attached to the first and second flanges when viewing the mask body from the side.

11. The filtering face-piece respirator of claim 1, wherein the filtering structure is secured to the support structure at a plurality of locations where the at least one transversely-extending member meets the filtering structure.

12. The filtering face-piece respirator of claim 1, wherein the at least one transversely-extending member that is not joined together by an longitudinally-extending member that hinders movement in the longitudinal dimension can move at least 10 millimeters when subjected to a force of only 0.3 Newtons when subjected to the Transversely-Extending Member Movement Test.

13. The filtering face-piece respirator of claim 12, wherein the at least one transversely-extending member that is not joined together by an longitudinally-extending member that hinders movement in the longitudinal dimension can move a greater distance along a center line than at the first and second sides of the mask body.

14. The filtering face-piece respirator of claim 1, wherein the at least one longitudinally-movable, transversely-extending member that is not joined together by an longitudinally-extending member that hinders movement in the longitudinal dimension can move longitudinally at the center line over a distance of about 5 to 35 millimeters without causing significant structural injury to the transversely-extending member when subjected to the Transversely-Extending Member Movement Test at a force of only about 0.7 Newtons or less.

15. The filtering face-piece respirator of claim 1, wherein the whole mask body may be expanded up to 20 to 35 millimeters without causing damage thereto when subjected to the Respirator Expansion Test.

16. The filtering face-piece respirator of claim 1, wherein the support structure is made from plastic and is able to exhibit sufficient resilience, shape memory, and resistance to flexural fatigue such that the support structure can be deformed many times and return to its original position.

17. The filtering face-piece respirator of claim 1, wherein the support structure material comprises plastic that exhibits a Stiffness in Flexure of about 75 to 300 Mega Pascals.

18. The filtering face-piece respirator of claim 1, wherein the support structure material comprises plastic that exhibits a Stiffness in Flexure of about 100 to 250 Mega Pascals.

19. The filtering face-piece respirator of claim 1, wherein the support structure material comprises plastic that exhibits a Stiffness in Flexure of about 175 to 225 Mega Pascals.

20. The filtering face-piece respirator of claim 1, wherein the support structure only includes peripheral transversely-extending members, and wherein the peripheral transversely-extending members enable the mask body to be expanded in the longitudinal dimension at least 2 cm under the Respirator Expansion Test.

21. A filtering face-piece respirator that comprises:

(a) a harness; and (b) a mask body that comprises:

(i) a filtering structure; and (ii) a support structure that comprises (1) a perimeter that includes one or more members, and (2) at least one longitudinally moveable, transversely-extending member that extends from a first side to a second side of the support structure and that is disposed within the perimeter when the mask body is viewed from the front, wherein the filtering structure is secured to the support structure at one-or more locations, and wherein the filtering structure and the support structure are adapted to enable the mask body to expand 30% longitudinally at a force of 10 Newtons or less applied according to the Respirator Expansion Test.

22. The filtering face-piece respirator of claim 21, wherein the 30% expansion can be achieved at a force of 7 Newtons or less.

23. A method of making a filtering face piece respirator, which method comprises:

(a) providing a support structure that comprises:

(i) a perimeter that includes one or more members, and (ii) at least one longitudinally-movable, transversely-extending member that extends from a first side to a second side of the support structure and that is disposed within the perimeter when the mask is viewed from the front;

(b) joining a filtering structure to the support structure at one or more locations to create a mask body, the filtering structure and support structure being joined together and being adapted such that the mask body can exhibit a 30% tensile expansion in the longitudinal dimension when exposed to a load of 10 Newtons or less under the Respirator Expansion Test; and (c) securing a harness to the mask body.

* * * * *